US007803416B2

(12) United States Patent
Roveda et al.

(10) Patent No.: US 7,803,416 B2
(45) Date of Patent: Sep. 28, 2010

(54) PACKAGING PROCESS FOR FRESH MEAT PRODUCTS, FRESH MEAT PACKAGE OBTAINABLE THEREBY AND TWIN LIDDING FILM SUITABLE THEREFOR

(75) Inventors: Carmen Roveda, Nerviano (IT); Stefano Capitani, Como (IT)

(73) Assignee: Cryovac, Inc., Duncan, SC (US)

( * ) Notice: Subject to any disclaimer, the term of this patent is extended or adjusted under 35 U.S.C. 154(b) by 282 days.

(21) Appl. No.: 11/884,638

(22) PCT Filed: Feb. 8, 2006

(86) PCT No.: PCT/EP2006/001091

§ 371 (c)(1),
(2), (4) Date: Aug. 17, 2007

(87) PCT Pub. No.: WO2006/087125

PCT Pub. Date: Aug. 24, 2006

(65) Prior Publication Data

US 2009/0022860 A1 Jan. 22, 2009

(30) Foreign Application Priority Data

Feb. 18, 2005 (EP) ..... 05101244

(51) Int. Cl.
*B65D 77/20* (2006.01)

(52) U.S. Cl. ..... 426/396; 426/127; 426/129; 53/478; 156/152

(58) Field of Classification Search ..... 426/118, 426/127, 129, 396; 156/152, 344; 53/319.3, 53/389.2, 389.4, 403, 427, 433, 441, 449, 53/471, 478, 485, 509; 206/439
See application file for complete search history.

(56) References Cited

U.S. PATENT DOCUMENTS 3,681,092 A * 8/1972 Titchenal et al. ..... 426/412

(Continued)

FOREIGN PATENT DOCUMENTS

EP 0 590 465 A1 4/1994

(Continued)

*Primary Examiner*—David R Sample
*Assistant Examiner*—Walter Moore
(74) *Attorney, Agent, or Firm*—Thomas C. Lagaly

(57) ABSTRACT

A method of packaging a fresh meat product on a support member (6) lidded with a twin lidding film (3) including an inner oxygen permeable film (15) and an outer gas impermeable film (16), by providing the twin lidding film (3) as a composite wound up on a single supply roll and, following unwinding and before entering into a lidding station (4), briefly separating the two films (15) and (16) before superposing them again one over the other before the sealing step.

7 Claims, 7 Drawing Sheets

U.S. PATENT DOCUMENTS

| | | | | |
|---|---|---|---|---|
| 4,495,016 | A * | 1/1985 | Viberg et al. | 156/152 |
| 5,103,618 | A | 4/1992 | Garwood | |
| 5,226,531 | A | 7/1993 | Garwood | |
| 5,348,752 | A | 9/1994 | Gorlich | |
| 5,402,622 | A | 4/1995 | Stockley, III et al. | |
| 5,558,930 | A * | 9/1996 | DiPoto | 428/216 |
| 5,560,182 | A | 10/1996 | Garwood | |
| 6,044,622 | A * | 4/2000 | Brady et al. | 53/412 |
| 6,513,564 | B2 * | 2/2003 | Bryan et al. | 156/584 |
| 6,698,165 | B1 | 3/2004 | Natterer | |
| 6,739,113 | B1 * | 5/2004 | Kocher et al. | 53/442 |
| 2004/0081731 | A1 * | 4/2004 | Hood | 426/393 |

FOREIGN PATENT DOCUMENTS

| | | | |
|---|---|---|---|
| EP | 0 690 012 | A1 | 1/1996 |
| EP | 0 729 900 | A2 | 9/1996 |
| EP | 0 769 454 | | 4/1997 |

* cited by examiner

PACKAGING PROCESS FOR FRESH MEAT PRODUCTS, FRESH MEAT PACKAGE OBTAINABLE THEREBY AND TWIN LIDDING FILM SUITABLE THEREFOR

TECHNICAL FIELD

The present invention refers to a method of packaging a fresh meat product on a support member lidded with a twin lidding film comprising an inner, oxygen-permeable, and an outer, oxygen-impermeable, lidding film where meat discoloration is prevented also where the oxygen-impermeable film is in close proximity to the surface of the meat product. The present invention also refers to a new fresh meat package obtainable thereby, and to a new twin lidding system particularly suitable for use in said method of packaging.

BACKGROUND ART

EP-A-690,012 describes a barrier package for fresh meat products where the meat product is loaded onto a support member, such as a tray, and the package is then closed by applying an inner oxygen-permeable film over the product and the support member and an outer oxygen-impermeable film over the oxygen-permeable one. The two films are at least 0.25 μm apart, the space between them comprises an oxygen-permeable region and a minimum discrete free volume within the package is present to contain at least the amount of oxygen necessary to inhibit discoloration of the packaged meat product during its shelf-life. The teaching of EP-A-690,012 is that by keeping such a minimum gap between the two films the oxygen contained in the package will have access to the entire surface of the meat product, including the upper one where the inner oxygen permeable film is (or may come) in contact with the meat. Discoloration is thus prevented also when the packaged meat extends upwardly with respect to the height of the tray walls, which is the most critical situation in barrier packaging of fresh meat.

EP-A-690,012 illustrates various alternative packages where the combination of inner oxygen-permeable and outer oxygen-impermeable films complies with the claimed requirements. However in the detailed description it concentrates on the embodiments where the spacing between the two films, where oxygen may freely circulate, is obtained by means of a particulate composition present between the two films.

In a comparative example of EP-A-690,012, carried out in the absence of particulate, the thin oxygen permeable region between the two films was not maintained and meat discoloration was observed at top surface.

In another comparative example of EP-A-690,012, the process used to maintain the gap between the two lidding films, in the absence of particulate, led to a loose outer package and unacceptable pack appearance.

While the particulate used in EP-A-690,012 is said not to negatively affect the optics of the package, nonetheless it would be preferable to avoid the presence of such particulate for many reasons, e.g., improving the overall pack appearance, avoiding possible food contamination, increasing the number of alternative films and combinations thereof that could suitably be employed, etc.

The Applicant has therefore thoroughly investigated this packaging system and has discovered that it is possible to obtain a twin lidded package as claimed in EP-A-690,012, with an acceptable pack appearance, without the need of a particulate material between the two lidding films, by a lidding process where the two lidding films are superposed one to the other and wound together in a single supply roll and, before entering into the lidding station, are briefly separated and then again superposed one over the other, thus allowing a thin layer of gas to be trapped between the two. This film separation can be achieved very easily by means of one or more poles positioned in the packaging line after the lidding film unwinding station and before the lidding station.

The use of the lidding films in the form of a composite of two films, wound superposed in a single roll, besides allowing the use of conventional lidding machines with just a minor modification for the films temporary separation, has the great advantage of giving an exceptional pack appearance as no wrinkles or plies are created in the lidding process due to the fact that the two films are equally tensioned in the supply roll. This is achieved in the manufacture of the single supply roll by separately and continuously adjusting the tension of the single films while unwinding them from their respective rolls to compensate for the different elongations.

The brief separation between the two films before the lidding step allows the creation or reconstitution of a thin air layer between the two, where the air contained therein will then be freely exchanged through the oxygen-permeable food-contact lidding film with the oxygen that will be present within the end package. This will be sufficient to prevent meat discoloration even in those points (top surface) where the inner oxygen-permeable film is in contact with the meat product (or may come in contact with the meat product when the package is e.g. vertically displayed in the shelves or incorrectly handled in the distribution cycle) and the visual impression is that the outer oxygen-impermeable film, particularly if shrunk, is in its turn in contact with the oxygen-permeable inner film.

The Applicant has also found that particularly good results can be obtained using thin lidding films.

Particularly it has been found that the use of a thin food-contact gas-permeable film will guarantee a quick and easy oxygen-exchange between the thin oxygen-permeable region separating the two lidding films and the discrete free volume of the package containing the amount of oxygen required to prevent discoloration. This oxygen-exchange is necessary during the whole shelf-life of the package as oxygen is gradually absorbed by the meat and discoloration can therefore be prevented only if the amount of oxygen consumed in the thin layer close to the meat surface is continuously restored.

Also the oxygen-impermeable film needs not to be thick and it has been found that if its thickness is controlled, also the pack appearance is improved.

Furthermore it has been found that when according to a preferred embodiment of the invention the lidding films are heat-shrinkable, using thin films it is easier to avoid tray distortion that otherwise might occur with some of the conventional rigid or foamed trays on the market.

The Applicant has also found that a composite of thin lidding films suitable for use in this packaging system can conveniently be obtained by delaminating a suitably selected oxygen-barrier film into an oxygen-permeable portion and an oxygen-impermeable portion and then superposing said two components, in a sort of inverted position, to guarantee heat-sealability of the films and thus package hermeticity.

These findings are underlying the present invention.

DISCLOSURE OF THE INVENTION

A first object of the present invention is a process for the manufacture of a fresh meat package by placing the meat product on a support member and closing the package under a high oxygen-content atmosphere by means of a twin lidding film, comprising an inner, food-contact, oxygen-permeable film and an outer oxygen-impermeable film, said twin lidding film being positioned over the meat product and heat-sealed to the periphery of the support member so as to bind a confined volume within the package containing at least an amount of oxygen effective to inhibit discoloration of the packaged meat product, said process being characterized in that the twin lidding film is used as a composite wound up on a single supply roll; and following unwinding and before entering into the lidding station, the twin lidding film is briefly separated into its two components which are then superposed again one over the other before the sealing step.

In a preferred embodiment the lidding films, or at least the inner oxygen-permeable one, are biaxially oriented and heat-shrinkable and the packaging process involves a heat-treatment to get the shrink thereof and cure any wrinkles in the lids. Such a heat-treatment may be a separate step following the heat-sealing one or—preferably—is part of the heat-sealing step, i.e. the temperature reached in the sealing station due to the presence of the heat-sealing frame is sufficient to get the desired shrink of the lid(s).

As in the lidding process of the present invention the two films enter into the lidding station as a composite, being superposed one to the other with the thin air layer entrapped therebetween, it is not expected that the distance between the two lidding films in the end package may be higher than 1 mm.

The separation between the oxygen-permeable and the oxygen-impermeable films in the process according to the present invention may be obtained by interposing between the two films which are brought from the unwinding supply roll to the support lidding station and are kept tensioned, one or more poles perpendicular to the direction of travel of the film and parallel to the film web.

Fresh meat that can advantageously be packaged by the method of the present invention includes fresh red meat, fresh poultry, with or without skin, fresh pork, and fresh fish; preferably the packaged meat will be fresh red meat (e.g. fresh beef, fresh lamb, fresh horse, and fresh goat), fresh pork and fresh poultry.

A second object of the present invention is a fresh meat package obtainable by the method of the first object, wherein the space between the two facing surfaces of the lidding films does not comprise any particulate material.

A third object of the present invention is a packaged fresh meat product comprising a fresh meat product in a package comprising a support member supporting on its base the fresh meat product;

an oxygen permeable film over the fresh meat product and the support member and sealed to the support member periphery;

an oxygen-impermeable film over the oxygen-permeable one but distant at least 0.25 μm therefrom and sealed to the oxygen permeable film at the support member periphery, said film bounding at least a portion of a confined volume within the package, which confined volume comprises a gas comprising an amount of oxygen effective to inhibit discoloration of the fresh meat product, wherein the inner, food-contact, oxygen-permeable film is a heat-shrinkable film of a thickness lower than 15 μm, preferably lower than 12 μm, and more preferably lower than 10 μm and the outer oxygen-impermeable film has a thickness lower than 25 μm, preferably lower than 20 μm, and more preferably lower than 18 μm.

In a preferred embodiment the space between the two facing surfaces of the lidding films does not contain any particulate material.

The support member can be flat or substantially planar but is preferably formed in the shape of a tray. That is, the support member necessarily includes product support surface for receiving and supporting the product being packaged and a periphery to which the oxygen-permeable film is sealed. Preferably the support member includes a downwardly formed cavity and an upper flange, wherein the product support surface is defined by the downwardly formed cavity and the upper flange is the periphery of the support member.

In a preferred embodiment also the outer oxygen-impermeable film is a heat-shrinkable film.

When both films are heat-shrinkable they will preferably be selected in such a way to provide a comparable % shrink at the temperature reached by each of the two films in the heat-treatment step. In particular as the inner oxygen-permeable film will reach a temperature slightly lower than the outer oxygen-impermeable one, because it is closer to the cold packaged product and farther from the heat source, preferably the inner oxygen-permeable film will have a % free shrink comparable to that of the outer oxygen-barrier film at a temperature which is few degrees lower.

When one or both films are heat-shrinkable, they will preferably have a low shrink force, particularly in the transverse direction.

The shrink force is the force released by the material during the shrinking process and a low shrink force of the lidding films, particularly in the transverse direction, will be useful to prevent possible distortion of the support member. The method which is used to evaluate this parameter has been described in EP-A-729900.

Typically the heat-shrinkable films will have a maximum shrink force, at least in the transverse direction, at the temperature reached in the heat-sealing station, or in the heat-treatment step if separate, not higher than 0.05 kg/cm, preferably not higher than 0.04 kg/cm. This can be obtained by suitably selecting the resins used for the films or their sequence in the film structures, or by suitably setting some of the process parameters (orientation temperature, orientation ratio) involved in the manufacture of the heat-shrinkable films, or by submitting heat-shrinkable films with a high shrink force to an annealing step, or by a combination of these means.

If both films are heat-shrinkable, the shrink tension of the outer oxygen-barrier film will preferably be comparable, or more preferably will be slightly lower than that of the inner oxygen-permeable film.

While thin films that can suitably be employed for the manufacture of said package can be obtained directly by extrusion or coextrusion, followed by orientation, when a heat-shrinkable film is desired, it is also possible to obtain a suitable twin lidding film combination by starting from a suitably designed oxygen-impermeable precursor film, comprising two outer heat-sealable layers (hs1, hs2) and a core oxygen-barrier layer; delaminating said film into an oxygen-permeable portion comprising one of the two outer layers of the starting oxygen-impermeable precursor film (hs1) and an oxygen-impermeable portion comprising the oxygen-barrier layer and the other outer heat-sealable layer of the starting oxygen-impermeable precursor film (hs2); and suitably inverting the relative position of the oxygen-impermeable portion in such a way that the outer heat-sealable layer (hs2)

in said portion will be the layer directly facing the oxygen-permeable portion in the twin lidding film.

This is necessary because, once the compatibility between the two layers defining the delamination interface therebetween has been reduced in order to achieve an easy delamination, it will not be possible to heat-seal them together with a seal strength sufficient to guarantee package hermeticity.

This "inversion" can be obtained, following delamination, by turning the oxygen-impermeable portion of the film upside down before superposing the two portions and winding them up on the single supply roll, or alternatively by winding up the delaminated film on the single roll without any inversion, removing from the thus obtained supply roll the first spire of the external film only and then unwinding the twin lidding film therefrom with the outer heat-sealable layer (hs2) of the oxygen-impermeable portion facing the oxygen-permeable portion of the same twin lidding film.

In the former case, the heat-sealable layer (hs1) of the oxygen-permeable portion, will remain the layer involved in the sealing of said portion to the support, and in case said oxygen-permeable portion has only one layer, the surface of said single layer that will be heat-sealed to the periphery of the support member will be the outer surface of the heat-sealable layer (hs1) of the precursor film. In the latter case, on the contrary, it will be the surface of the oxygen-permeable portion involved in the delamination that will be heat-sealed to the periphery of the support member in the end package.

A further object of the present invention is a packaged fresh meat product comprising a fresh meat product in a package comprising

- a support member supporting on its base the fresh meat product;
- an oxygen permeable film over the fresh meat product and the support member and sealed to the periphery of the support member;
- an oxygen-impermeable film over the oxygen permeable one but distant at least 0.25 μm therefrom and sealed to the oxygen-permeable film at the periphery of the support member, said film bounding at least a portion of a confined volume within the package, which confined volume comprises a gas comprising an amount of oxygen effective to inhibit discoloration of the fresh meat product, said package being characterised in that the twin lidding film comprising the oxygen-permeable and the oxygen-impermeable films is obtained by i) delaminating a suitably designed oxygen-impermeable precursor film that comprises a core oxygen-barrier layer and two outer heat-sealable layers (hs1, hs2) into an oxygen-permeable portion comprising one of the two outer layers of the precursor film (hs1) and an oxygen-impermeable portion comprising the oxygen-barrier layer and the other outer heat-sealable layer of the precursor film (hs2) and ii) suitably inverting the relative positioning of the oxygen-impermeable portion in such a way that the outer heat-sealable layer (hs2) in said portion will be the layer directly facing the oxygen-permeable portion in the twin lidding film.

Still further objects of the present invention are a supply roll of a composite of an oxygen-permeable film and an oxygen-impermeable film obtained by delaminating a suitably designed oxygen-impermeable precursor film; a composite of an oxygen-permeable film and an oxygen-impermeable film obtained by delaminating a suitably designed oxygen-impermeable precursor film and inverting the position of at least the oxygen-impermeable portion; and the use thereof in the packaging process according to the first object of the present invention.

MODE(S) FOR CARRYING OUT THE INVENTION

The packaging method according to the present invention can be run on a conventional machine for lidding by introducing therein only minor modifications for the separation of the twin lidding film composite into its components before entering the lidding station.

Lidding machines that can suitably be adapted to run the process of the present invention include for instance Multivac 400 and Multivac T550 by Multivac Sep. GmbH, Mondini E380, E390 or E590 by Mondini S.p.A., Ross A20 or Ross S45 by Ross-Reiser, Meca-2002 or Meca-2003 by Mecaplastic, the tray lidding machines manufactured by Sealpac and the like machines.

Figure 1:
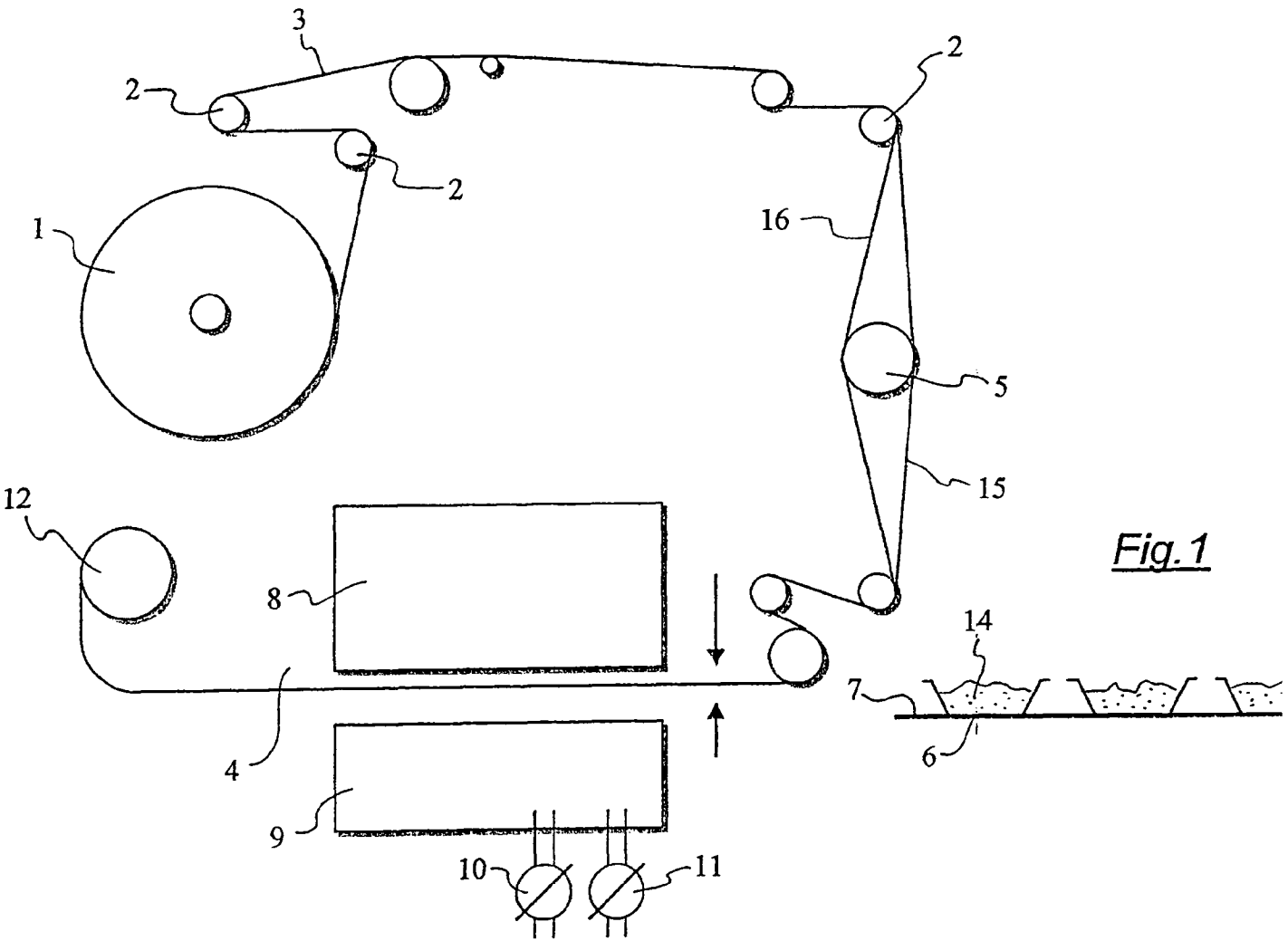
FIG. 1 is a simplified cross-sectional schematic of one embodiment of a packaging machine for carrying out the process of the invention.

The packaging machine schematically illustrated in FIG. 1, has an unwinding station (1) and a series of driving rolls (2) to guide, with the correct tension, the unwound twin lidding film (3) to the lidding station (4). A separating pole (5) is used to separate the two films of the twin lidding film composite (3). Said pole, which in the packaging machine of FIG. 1 is positioned just before the entrance of the lidding station (4), could be positioned anywhere along the film path, from the unwinding station (1) to the lidding station (4), and fixed securely to the machine frame. Fixing can be through one single end of the pole or preferably both ends to avoid undesired swinging. The support members (6), that in the embodiment of FIG. 1 are illustrated as shaped trays, are brought into the lidding station (4) by means of a conveyor (7). The lidding station is essentially a vacuum chamber including an upper chamber (8) and a lower chamber (9), that can be moved vertically, in opposite directions, to open and close the lidding station (4). The lower chamber (9) includes a carrier plate for nesting the support members (not shown in FIG. 1), which plate can be lifted upwardly for the sealing step. The lower chamber also has a vacuum port (10) and a port (11) for injecting the desired gas. The upper chamber (8) is equipped with heat-sealing frames (not shown in FIG. 1) that are designed to match with the periphery of the support members and that contour cavities sufficiently shallowed not to contact the lidding films covering the packaged products during the sealing step. Once the support members (6) are correctly positioned in the lower chamber (9), the upper chamber (8) and the lower chamber (9) move as indicated by the arrows to close the chamber. Port (10) is then actioned to vacuumize the chamber, including the space between the support members (6) and the lidding film (3), and when evacuation is complete, or when the pressure inside the chamber has reached the set value, port (10) is closed and port (11) is opened to inject the desired atmosphere.

Typically, the gas flushed in will have an oxygen content of at least 60% by volume, based on the total volume of gas flushing, preferably at least 80%, and more preferably at least 85%. Generally however oxygen is admixed with a small amount of an inert gas such as nitrogen, argon, carbon dioxide and the like gases.

Once the desired gas pressure is reached within the chamber and around the product to be packaged, port (11) is closed and the carrier plate nesting the support members in the lower chamber (9) is lifted upwardly to push the periphery of said support members, covered by the twin lidding film, against the heated sealing frames in the upper chamber (8), so as to heat-seal, by pressure, the periphery of the support members to the oxygen-permeable film (15) and the oxygen-permeable film (15) to the oxygen-impermeable one (16) at said periphery. The sealing frames are generally equipped with knives contouring the sealing frames on the outside to separate the single end packages from the skeleton of the twin lidding film. When the heat-sealing step is completed, the lower chamber (9) and the upper chamber (8) open up, the end packages are removed from the chamber and the skeleton of the twin lidding film is wound up on a scrap roll (12) at the exit of the lidding station. In the embodiment of FIG. 1 (14) are the fresh meat products to be packaged.

Figure 2A:
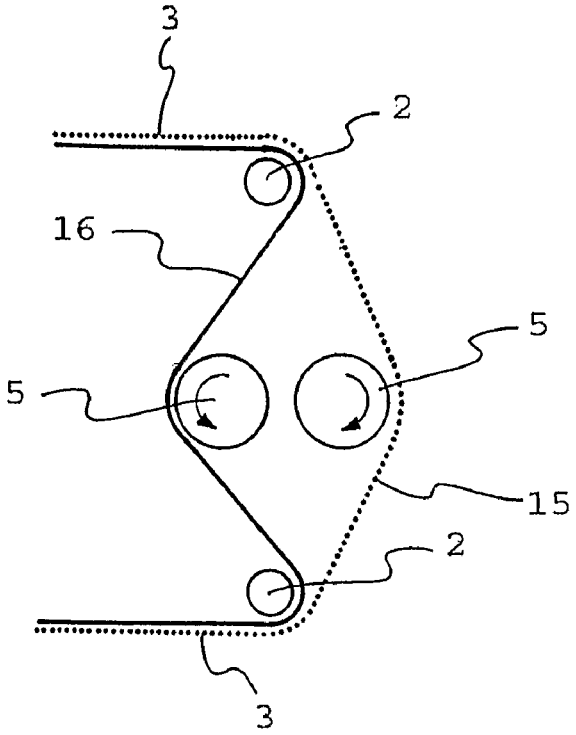
FIGS. 2*a* and 2*b* are simplified and enlarged cross-sectional views of different embodiments of separating poles.
Figure 2B:
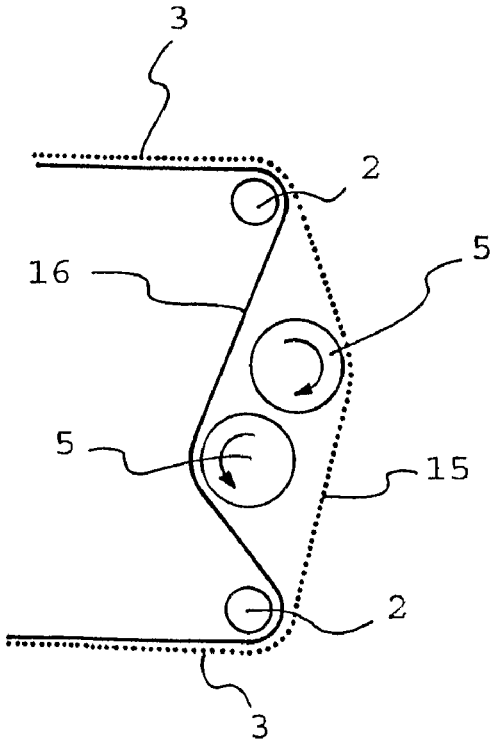

In the embodiment of FIG. 1 the separation is achieved by a single pole that either is fixed or can rotate freely. However as the movement of the two films on the opposing sides of the pole will exert a contrasting effect on the rotating movement of the pole, i.e. one clock-wise and the other one counter-clockwise, there would be no advantage to use a freely rotating pole and a fixed one will be preferred. On the contrary, when separation is achieved by means of two poles, as illustrated in FIG. 2*a* or 2*b*, the two poles would preferably be idle as each of them could rotate separately to match the direction of the film contacting it and this could reduce the friction. The direction of travel of the films and the rotation of the poles in FIGS. 2*a* and 2*b* are indicated by arrows.

It would also be possible to use more than two poles, differently disposed, or to provide for two or more separating steps along the film path, but these additional features would not bring any further significant advantage.

Suitable materials for the manufacture of the pole(s) are metal, fiberglass, polycarbonate, stone, etc. Possibly they might be coated with an anti-sticking polymeric material, such as for instance a Teflon® layer.

Figure 3:
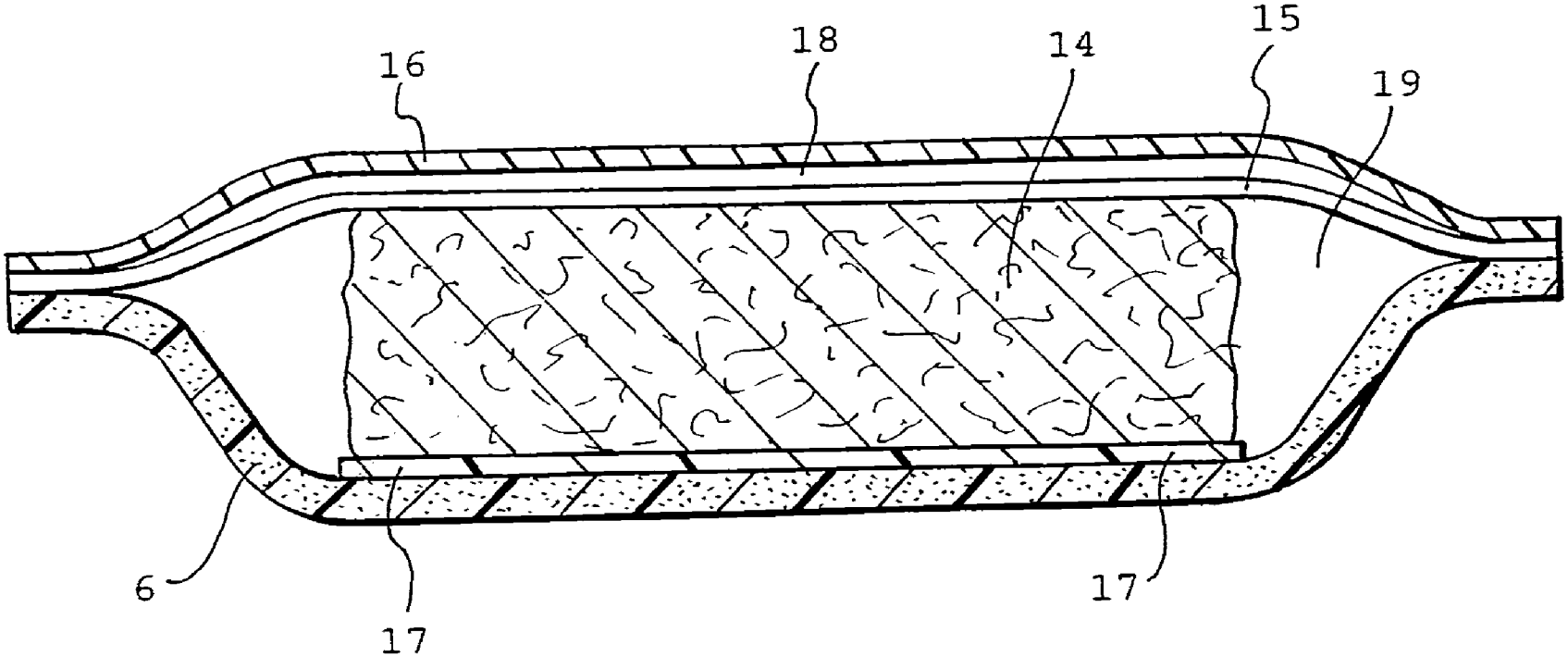
FIG. 3 is a schematic cross-sectional view of one embodiment of package according to the present invention.

FIG. 3 illustrates a package obtainable by the above process. The support member (6), that in the preferred embodiment illustrated in FIG. 3 is tray-shaped, can be semi-rigid or—preferably—rigid. As used herein the terms "rigid" and "semi-rigid" when referred to the support members (6) are intended to refer to either flat or tray-shaped supports that are capable of supporting themselves and have a specific shape, size and—if tray-shaped—volume, wherein, however, the shape of the "semi-rigid" supports may be reversibly changed by the application of a small pressure, while the "rigid" supports can tolerate a certain amount of physical forces without being deformed.

Support members (6) can be flat and have any desired shape, e.g. squared, rectangular, circular, oval, etc., or preferably they are tray-shaped with a base or bottom portion that can have any desired shape as seen above and side-walls extending upwardly and possibly also outwardly from the periphery of said base portion, and ending with a flange surrounding the top opening.

The support members for use in the packaging method of the present invention may be mono-layer or multi-layer structures, either foamed, partially foamed or solid.

Their thickness may widely range from about 200 μm for a solid structure to about 7 mm for a foamed one. Typically solid structures will have a thickness comprised between 200 μm and 3 mm, preferably comprised between 300 μm and 2.5 mm, and more preferably comprised between 400 μm and 2 mm while foamed or partially foamed structures will have a thickness comprised between 1 and 7 mm, preferably comprised between 2 and 6 mm, and more preferably comprised between 3 and 5 mm.

Suitable materials from which support members (6), or the bulk thereof, can be formed include styrene-based polymers, e.g. polystyrene and high impact polystyrene, nylons, polypropylene, high density polyethylene, polyesters, e.g., polyethyleneterephtalate and polyethylenenaphthalenate homo- and co-polymers, polyvinylchloride, and the like materials.

The support members (6) should have a food contact outer surface that is heat-sealable to the oxygen-permeable film of the twin lidding film. Therefore if the material used for the bulk structure is not heat-sealable it will be necessary to either laminate it with a mono- or multi-layer film comprising an outer heat-sealable layer or coextrude it with one or more layers including an outer heat-sealable layer. Alternatively it would be possible also to coat it, at least on the periphery of the support or on the flange of the tray, with a heat-sealable material.

The support members (6) should preferably provide a barrier to the passage of oxygen therethrough in order to maintain the desired high oxygen environment within the package. Thus they can be formed from a bulk material which itself has oxygen-barrier properties, or said bulk material is not oxygen-impermeable but is laminated with an oxygen-barrier film or they can be formed from a bulk material that is not an oxygen-barrier material but whose thickness is however high enough to drastically limit gas exchange with the environment.

Preferably said support members have an oxygen transmission rate (OTR) lower than 300 $cm^3/m^2$.d.atm when measured at 23° C. and 0% of relative humidity, such as for instance lower than 250 $cm^3/m^2$.d.atm or lower than 200 $cm^3/m^2$.d.atm or lower than 150 $cm^3/m^2$.d.atm, and more preferably lower than 100 $cm^3/m^2$.d.atm, such as for instance lower than 75 $cm^3/m^2$.d.atm or lower than 50 $cm^3/m^2$.d.atm or lower than 30 $cm^3/m^2$.d.atm, measured under the same conditions as above.

Preferred materials for the manufacture of support members (6) are e.g., a foamed polystyrene sheet laminated to a multi-layer oxygen-impermeable film comprising a polyolefin outer heat-sealable layer, a core oxygen-barrier layer comprising e.g. PVDC, EVOH, polyamides, or blends thereof, and a second outer binding layer that would increase the bond strength between the multi-layer film (liner) and the polystyrene bulk substrate; coextruded partially foamed structures comprising one or more layers of foamed polypropylene, an outer, food-contact, polyolefin heat-sealable layer and a core oxygen-barrier layer, typically comprising EVOH, polyamides, or blends thereof; paper pulp or cardboard material lined with a multilayer thermoplastic film comprising a first outer heat-sealable polyolefin layer, a core oxygen-barrier layer typically comprising EVOH, polyamides, or blends thereof, and a second outer adhesive layer, for instance of a modified polyolefin, to bind the film to the paper substrate; etc.

As used herein the term "polyolefin" refers to any polymerized olefin, which can be linear, branched, cyclic, aliphatic, aromatic, substituted, or unsubstituted. More specifically, included in the term polyolefin are heterogeneous or homogeneous homo-polymers of olefin, co-polymers of olefin, co-polymers of an olefin and a non-olefinic co-monomer co-polymerizable with the olefin, such as vinyl monomers, and the like. Specific examples include polyethylene homo-polymer, polypropylene homo-polymer, polybutene homo-polymer, ethylene-α-olefin co-/ter-polymer, propylene-α-olefin co-polymer, propylene-ethylene-α-olefin ter-polymer, butene-α-olefin co-polymer, ethylene-unsaturated ester co-polymer, ethylene-unsaturated acid co-polymer, (e.g. ethylene-ethyl acrylate co-polymer, ethylene-butyl acrylate co-polymer, ethylene-methyl acrylate co-polymer, ethylene-acrylic acid co-polymer, and ethylene-methacrylic acid co-polymer), ethylene-vinyl acetate copolymer, ionomer resin, etc.

As used herein the term "modified polyolefin" is inclusive of polyolefins, as defined above, modified by co-polymerizing the homo-polymer of the olefin or co-polymer thereof with an unsaturated carboxylic acid, e.g., maleic acid, fumaric acid or the like, or a derivative thereof such as the anhydride, ester or metal salt or the like. It is also inclusive of polyolefins modified by incorporating into the olefin homo-polymer or co-polymer, by blending or preferably by grafting, an unsaturated carboxylic acid, e.g., maleic acid, fumaric acid or the like, or a derivative thereof such as the anhydride, ester or metal salt or the like.

The end package may also contain an absorbing pad (17), e.g. positioned on the supporting surface of the support member (6), underneath the fresh meat product (14) as known in the art or alternatively, if the support member is tray-shaped, it might contain a perforated false bottom separating the packaged product from a reservoir in the bottom of the tray where the drip may be collected and removed from sight.

The twin lidding film (3) closing the package is a composite of an inner food-contact oxygen-permeable film (15) and an outer oxygen-impermeable film (16). When using the process according to the present invention no particulate material needs to be present in the space (18) between the two films as the two films will be maintained at a distance sufficient for the permeation with oxygen by the thin air layer entrapped during the film separation step.

Oxygen-permeable films are films that show an OTR of at least 2,000 $cm^3/m^2$.d.atm when measured at 23° C. and 0% of relative humidity, such as for instance at least 2,500 $cm^3/m^2$.d.atm or at least 3,000 $cm^3/m^2$.d.atm or at least 3,500 $cm^3/m^2$.d.atm, and more preferably at least 4,000 $cm^3/m^2$.d.atm, such as for instance at least 5,000 $cm^3/m^2$.d.atm or at least 8,000 $cm^3/m^2$.d.atm or at least 10,000 $cm^3/m^2$.d.atm, measured under the same conditions as above.

The oxygen-permeable film (15) can be a mono-layer or a multi-layer film. While the number of layers is not critical, preferred oxygen-permeable films will however contain 1, 2 or 3 layers.

Its thickness in fact can be as high as 50 μm or even more, but preferably it should be maintained below 15 μm, more preferably below 12 μm and even more preferably below 10 μm. Typically it will have a thickness of from about 6 or 7 μm to about 15 μm.

It will generally contain polyolefins or modified polyolefins as the polyolefin and modified polyolefin resins are oxygen-permeable and heat-sealable resins. One outer surface of the oxygen-permeable film should in fact heat-seal to the periphery of the support member (6) and the other outer surface should heat-seal to the oxygen-impermeable film (16).

However in certain cases the oxygen-permeable film (15) may comprise different resins e.g., suitably selected for the food-contact layer to be heat-sealable to the support member (6). As an example when the support member (6) is formed of polyethyleneterephthalate (PET), the inner oxygen-permeable film may be multi-layer film comprising a very thin (1-2 μm) outer food-contact layer of PET and the other outer layer of a resin suitable to heat-seal to the oxygen-impermeable film (16), provided the multi-layer film is oxygen-permeable as defined above.

Preferably the oxygen permeable film is a heat-shrinkable film, wherein the term "heat-shrinkable" as used herein is intended to mean that the film is biaxially oriented and when heated at a temperature of 120° C. for 4 seconds shows a % free shrink in each of the longitudinal and transversal directions of at least 10% (measured according to ASTM D2732).

The oxygen-permeable film may contain appropriate amounts of additives normally used in film manufacture, such as slip and anti-block agents e.g., talc, waxes, silica, and the like, antioxidants, fillers, pigments and dyes, cross-linking inhibitors, cross-linking enhancers, UV absorbers, antistatic agents, anti-fog agents or compositions, and the like additives known to those skilled in the art of packaging films.

In a preferred embodiment the oxygen-permeable film (15) will comprise anti-fog agents or compositions to prevent formation of water droplets on the film surface facing the fresh meat product. The anti-fog agents can be admixed to the polymers or polymer blends of the heat-sealable layer or of an inner layer, if any, before (co)extrusion of the film or an anti-fog composition can be coated onto the surface of the pre-made oxygen-permeable film.

The oxygen-impermeable film will have an oxygen transmission rate (OTR) lower than 300 $cm^3/m^2$.d.atm when measured at 23° C. and 0% of relative humidity, such as for instance lower than 250 $cm^3/m^2$.d.atm or lower than 200 $cm^3/m^2$.d.atm or lower than 150 $cm^3/m^2$.d.atm, and more preferably lower than 100 $cm^3/m^2$.d.atm, such as for instance lower than 75 $cm^3/m^2$.d.atm or lower than 50 $cm^3/m^2$.d.atm or lower than 30 $cm^3/m^2$.d.atm, measured under the same conditions as above.

It should have oxygen-barrier properties and be heat-sealable to the oxygen-permeable film.

Preferably the oxygen-impermeable film (16) will therefore be a multi-layer film comprising at least an oxygen-barrier layer, the thickness of which should be set to achieve the desired OTR for the film indicated above, and a heat-sealable layer that allows heat-sealing of the oxygen-impermeable film to the oxygen-permeable one. Polymers that can suitably be employed for the oxygen barrier layer are PVDC, EVOH, polyamides and blends thereof, wherein EVOH, polyamides, and their blends are the preferred resins. Typically the heat-sealable layer will comprise polyolefins and/or modified polyolefins as defined above.

Other layers can be present, if desired, such as for instance a second outer layer which may have a composition equal to or different from the heat-sealable layer, tie or adhesive layers, containing polyolefins and/or modified polyolefins, to improve the bond between the barrier layer and the heat-sealable layer and optionally between the barrier layer and the other outer layer, a seal-assist layer, i.e. an internal film layer adjacent to the heat-sealable one, etc.

Preferably the thickness of the oxygen-impermeable film (16) will be lower than 25 μm, more preferably lower than 20 μm, and even more preferably lower than 18 μm.

The number of layers in the oxygen-impermeable film is not critical. Typically oxygen-impermeable films will contain up to 9-10 layers, preferably up to 7, and more preferably 2 to 5 layers.

In the package illustrated in FIG. 3, (19) is the volume within the package, bound by the twin lidding film that comprises a gas comprising an amount of oxygen effective to inhibit discoloration of the fresh meat product.

Suitable combinations of thin oxygen-permeable and oxygen-impermeable films can be obtained starting from an oxygen-impermeable precursor film (20) comprising a core oxygen-barrier layer (barrier), and two outer heat-sealable layers (hs1, hs2), wherein two adjacent layers in said precursor film are poorly compatible and can easily delaminate at the interface defined therebetween to give an oxygen-permeable portion and an oxygen-impermeable portion. Two adjacent layers in the precursor film are defined as "poorly compatible" when the bond strength between said two layers is less than about 40 g/25 mm, preferably less than about 30 g/25 mm, more preferably less than about 20 g/25 mm, and even more preferably less than about 10 grams/25 mm.

As used herein, the term "bond strength" between two adjacent layers refers to the adhesive strength between these two layers which binds them to one another, as measured in a direction that is generally perpendicular to the plane of the film. It is measured by the minimum amount of force (the "delaminating force") required to internally separate (delaminate) a film between these given layers in accordance with ASTM F904-91. The precursor film must have at least three layers. Preferably however it has 4 or more layers. Typically, of the two adjacent layers that are poorly compatible, one is the core oxygen-barrier layer and delamination will occur therefore at the interface with said barrier layer. The barrier layer typically comprises PVDC, EVOH, polyamides, or blends thereof wherein EVOH, polyamides and their blends are preferred.

Examples of oxygen-impermeable precursor films that can be delaminated to give an oxygen-permeable and an oxygen-impermeable portion include structures with four layers hs1/barrier/tie/hs2, where the resulting oxygen permeable portion will be a mono-layer film hs1, five layer structures hs1/layer1/barrier/tie2/hs2, where the compatibility between layer1 and the barrier layer is poor and the delamination will lead to an oxygen-permeable film with two layers hs1/layer1, or six layer structures such as hs1/layer1/barrier/tie2/layer2/hs2 or hs1/tie1/layer1/barrier/tie2/hs2 or hs1/layer2/layer1/barrier/tie2/hs2, etc., where the delamination at the interface between the barrier layer and layer 1 will lead to 2- or 3-layer oxygen-permeable films.

The precursor film may also contain more than one oxygen-barrier layer, such as for instance a two layer sequence polyamide/EVOH or a three-layer sequence polyamide/EVOH/polyamide.

Examples of such films are for instance represented by the six-layer structures hs1/polyamide/EVOH/polyamide/tie2/hs2 or hs1/layer1/polyamide/EVOH/tie2/hs2, or by the seven-layer structure hs1/layer1/polyamide/EVOH/polyamide/tie2/hs2. In these cases delamination might suitably occur at the interface between said barrier sequence and layer hs1 or layer1, thus leading to a mono-layer or two-layer oxygen-permeable portion hs1 or hs1/layer1 respectively, and to a four or five layer oxygen-impermeable portion polyamide/EVOH/tie2/hs2 or polyamide/EVOH/polyamide/tie2/hs2.

Figure 4:
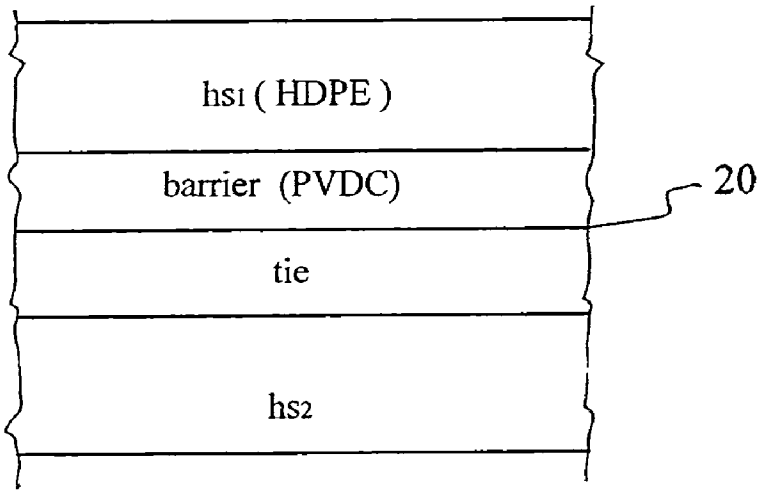

FIG. 4 illustrates an example of a 4-layer precursor film where the compatibility between layer hs1 (e.g., high density polyethylene—HDPE) and the core barrier layer (e.g. PVDC) is very low and delamination will occur at the interface between hs1 and the barrier layer.

Figure 5:
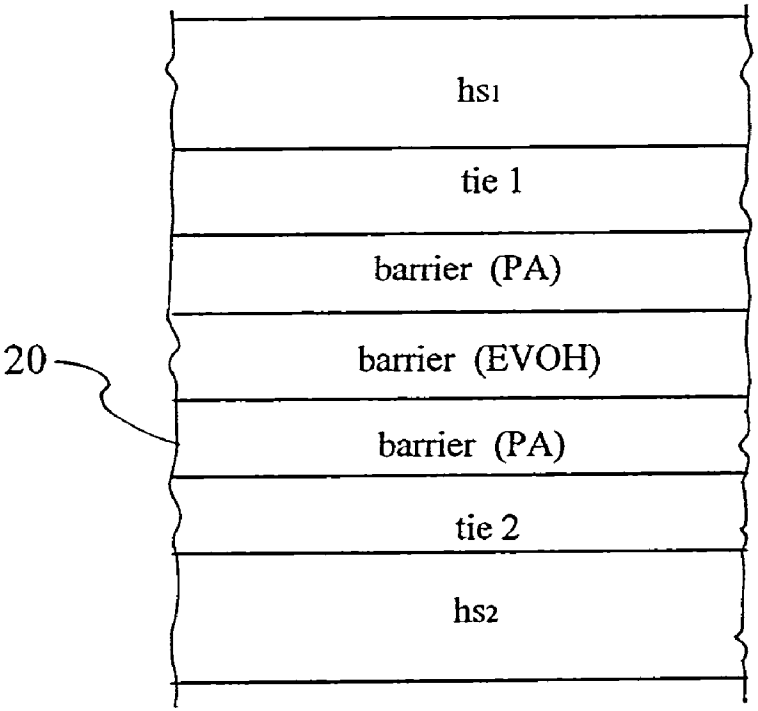
FIG. 4 and FIG. 5 are enlarged and schematic cross-sectional views of non limitative examples of delaminatable oxygen-impermeable films that can be used as precursors for the new twin lidding film according to the invention.

FIG. 5 illustrates an example of a 7-layer precursor film containing a core barrier sequence PA/EVOH/PA and one of the two tie layers adjacent to said sequence (tie1) has a very poor compatibility with the polyamide layer. In this case delamination will occur at the interface between the polyamide layer and said tie1 layer.

For use as twin lidding film in the process of the present invention it will not be possible to use the delaminated portions keeping the same sequence as in the precursor film because the two layers that are poorly compatible and have been involved in the delamination will not be able to heat-seal one to the other with a sufficient seal strength to guarantee package hermeticity.

Figure 8:
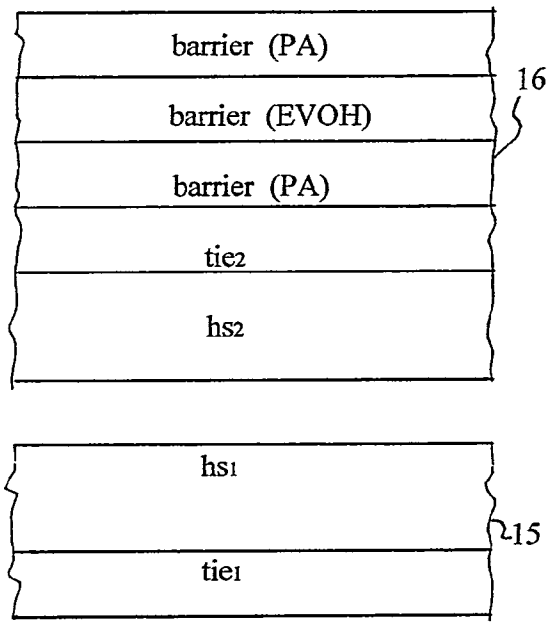
FIG. 7 and FIG. 8 illustrate the twin lidding film composite that can be obtained starting from the precursor film of FIG. 5.
Figure 7:
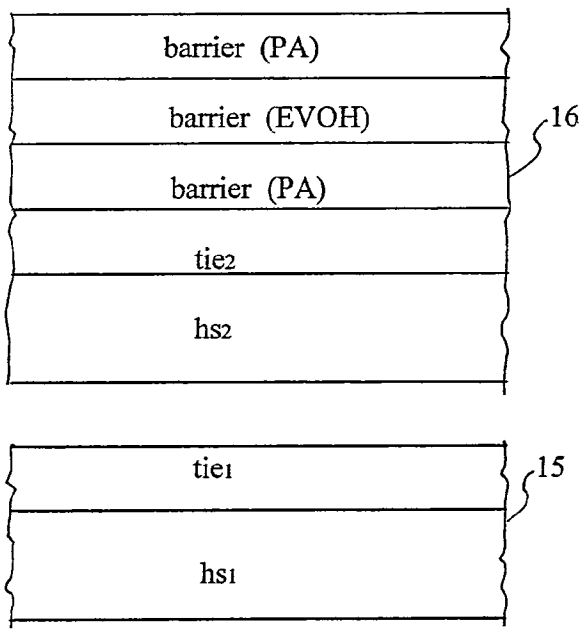
Figure 6:
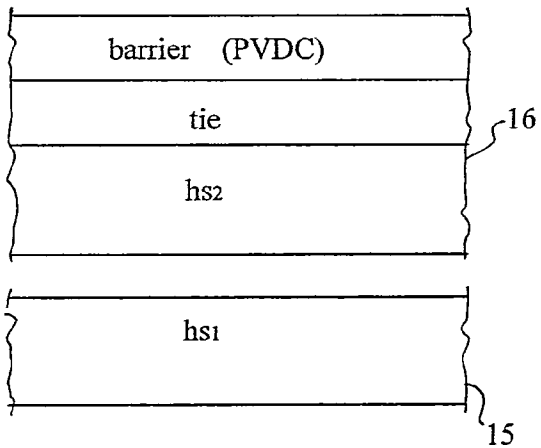
FIG. 6 illustrates the twin lidding film composite that can be obtained starting from the precursor film of FIG. 4.

It will be therefore necessary—as illustrated in FIG. 6 for the precursor film of FIG. 4 and in FIG. 7 and FIG. 8 for the precursor film of FIG. 5, to somehow invert the positioning of the oxygen-impermeable portion in such a way that the layer of said oxygen-impermeable portion that in the end package will be sealed to the oxygen-permeable portion is the outer heat-sealable layer of the precursor film remained in the oxygen-impermeable portion.

Figure 9:
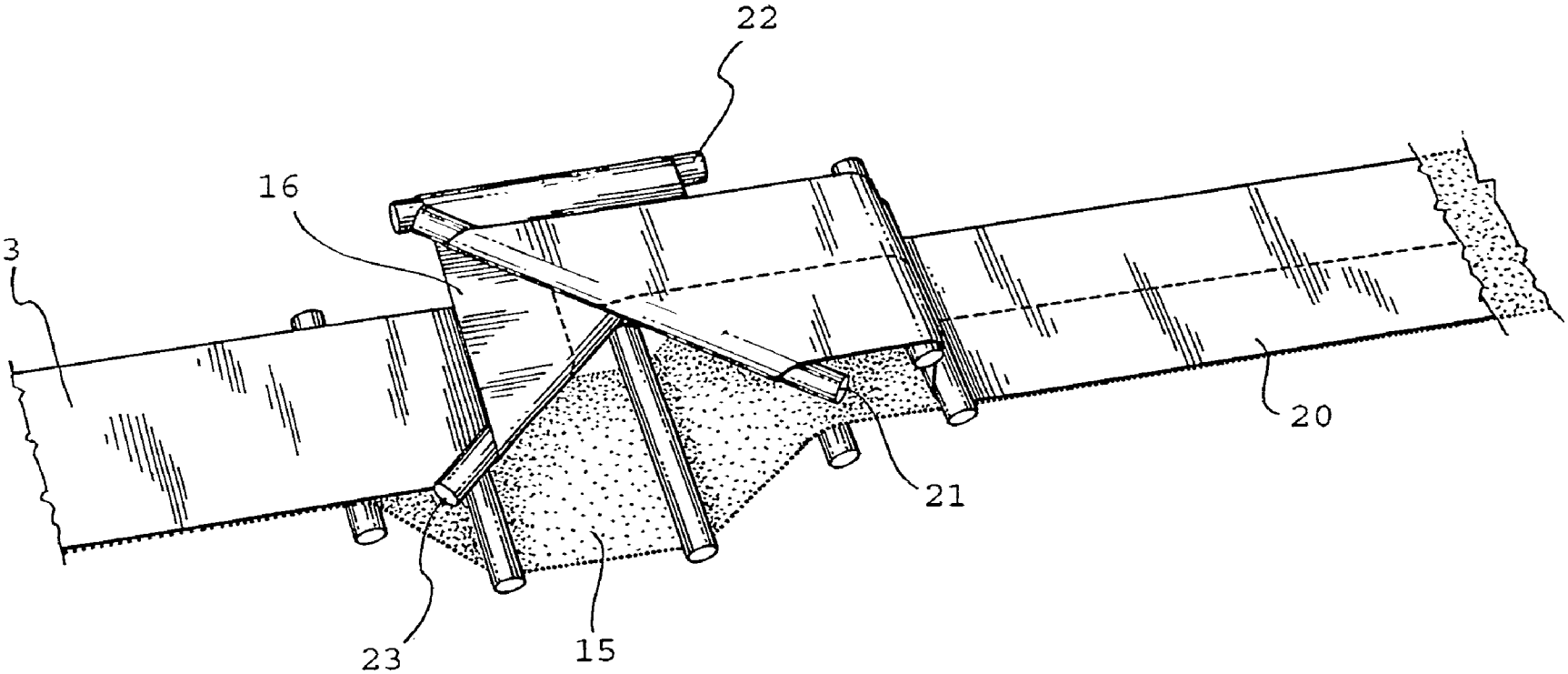
FIG. 9 schematically illustrates a device that can be used to invert the positioning of the oxygen-impermeable portion following delamination of a precursor film.
Figure 10:
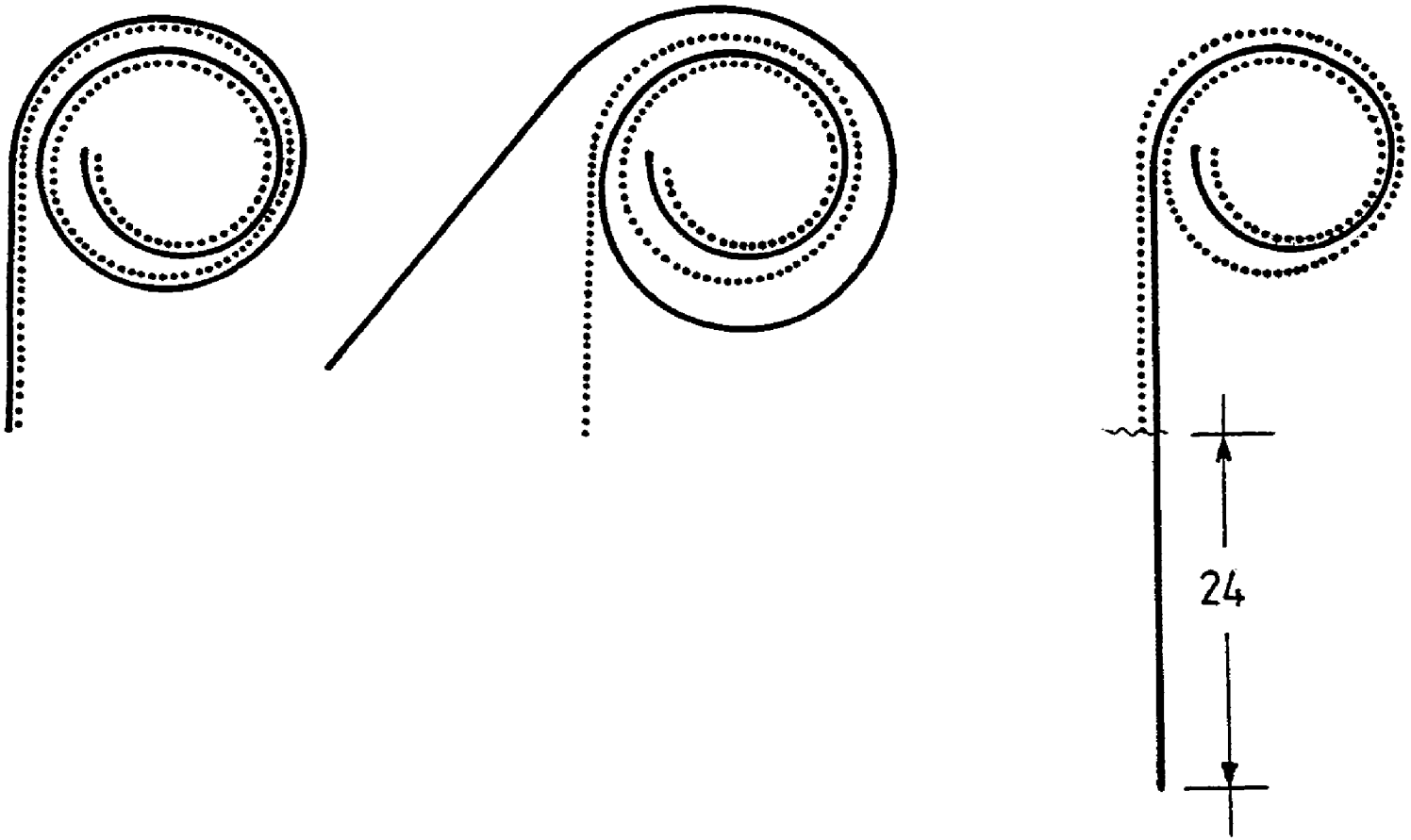
FIG. 10 is a simplified schematic showing sequential unwinding and removal of the first spire of the external film in the supply roll of the delaminated, not inverted, precursor, and then unwinding of the twin lidding film.

This can be achieved in two different ways, illustrated in FIGS. 9 and 10.

FIG. 9 illustrates a process where only the oxygen-impermeable portion is inverted with respect to the oxygen-permeable one, i.e. a process that can be used to obtain a twin lidding film where the surface of the oxygen-permeable film (15) that will be heat-sealed to the periphery of the support member (6) in the end package is the same outer surface of the heat-sealable layer of the precursor (20). In this process the precursor film (20) is delaminated and then the position of the oxygen-impermeable portion (16) is inverted, turning said portion upside-down by means of a film inverter mechanism involving three inverting rods (21, 22, 23). The inverted oxygen-impermeable portion (16) is then superposed to the oxygen-permeable one and the two are wound up together on the single supply roll (not shown in FIG. 9). In said Figure a line is drawn on the upper surface of the precursor film (20) to show more clearly the path of said surface in the inverting process. When the oxygen-impermeable film (16) is then superposed to the oxygen-permeable one (15) the line will no longer be visible because it will be on the hidden surface facing the oxygen-permeable film.

The process illustrated in FIG. 10 on the other hand can be used to obtain a twin lidding film where both the oxygen-impermeable and the oxygen-permeable portions obtained from the delamination of the precursor film are separately inverted so that the surface of the oxygen-permeable portion involved in the delamination becomes the surface of the oxygen-permeable film that is heat-sealed to the periphery of the support and the surface of the oxygen-impermeable portion involved in the delamination becomes the outer abuse resistant surface of the gas-impermeable film. This is obtained by delaminating the precursor film, winding up the two portions superposed with the same sequence as in the precursor film and removing from the obtained roll the first spire of only the external film (24). The supply roll thus obtained can suitably be employed in the packaging process of the present invention when it will be unwound by drawing the two superposed films to be used as the twin lidding composite.

The advantages of the process of the present invention have been shown by carrying out some comparative tests.

In these tests tray-shaped support members of foamed polystyrene lined with a 24 μm thick oxygen-barrier film comprising a core EVOH barrier layer and a heat-sealable outer layer of a heterogenous ethylene-α-olefin copolymer with density 0.920 g/cm$^3$ and as the twin lid a combination of a 15 μm thick oxygen-permeable film with a core layer of a heterogenous ethylene-α-olefin copolymer with density 0.920 g/cm$^3$ and two outer layers comprising a blend of a heterogenous ethylene-α-olefin copolymer with density 0.915 g/cm$^3$, a heterogenous ethylene-α-olefin copolymer with density 0.920 g/cm$^3$ and ethylene-vinyl acetate copolymer (with a VA content of 4%) containing 1.5 wt. % of an anti-fog composition as described in EP-739398. The oxygen-impermeable film was a 25 μm thick 7-layer symmetrical structure with a core EVOH layer, sandwiched between two polyamide layers, and two outer layers having the same composition as the outer layers of the oxygen-permeable film, bonded to the polyamide layers by a suitable tie layer. The OTR of the oxygen-permeable film was 10,000 cc/m$^2$.d.atm and that of the oxygen-impermeable one was 24 cc/m$^2$.d.atm. The % free shrink of the oxygen-permeable film at 120° C. was 35/40 (LD/TD) and the % free shrink of the oxygen-impermeable film at the same temperature was 15/20. The two films were wound up together on a single supply roll.

No particulate was present between the two films.

Cuts of fresh meat smaller than the tray cavity but few mm taller than the tray sidewalls have been packaged with said composite in a 95% oxygen atmosphere using a Multivac T400 machine modified by the insertion of a film separating pole essentially as described in FIG. 1. The packages thus obtained had a very nice pack appearance with no wrinkle and no plies on the lidding films and very good optics. These packages contained the products indicated in Table 1 below. They were maintained under refrigerated conditions and during the whole shelf-life period no visible discoloration of the meat could be observed, not even on the top surface. The shelf-life for each product, maintained under these conditions, is also reported in Table 1.

TABLE 1

| Type of meat | Shelf-life (days) |
|---|---|
| Rib steaks | 18 |
| Minced meat | 9 |
| Pork loins | 14 |
| Turkey legs | 13 |

Comparative tests have been carried using the same packaging materials but in Comparative process a) winding up the two lidding films on a single supply roll but without separating the two films before the tray lidding step and in Comparative process b) using the two films wound on two separated rolls and superposing them before entering the tray lidding station.

While in the packages obtained by Comparative process a) a clear discoloration could be observed on the top surface of the package where the films are in contact with the meat, with the packages obtained by Comparative process b) the pack appearance was unacceptable due to the presence of pleats and wrinkles.

To confirm that using the process of the present invention it is possible to guarantee the flow of oxygen between the oxygen-permeable film and the oxygen-impermeable film even on the top surface of the package where the film is in tight contact with, and stretched against, the meat, we have carried out additional tests isolating a small area in the lid by sealing the two films together and thus preventing oxygen flow to this area. We then put this area of the twin lid in direct contact with a cut of fresh red meat. As expected, the oxygen present in the small isolated area was quickly absorbed by the meat underneath and then the surface of the meat begun to darken due to the absence of oxygen that was prevented from flowing into the small isolated area by the heat-seals. In the surrounding area the meat colour continued to be red, evidence of a high oxygen level. These tests confirmed that the process of the invention allows to maintain a minimum gap between the two lidding films where the injected high oxygen modified atmosphere can continuously flow to prevent discoloration.

Additional small scale tests have been carried out manufacturing the twin lidding system by delamination of a precursor film essentially corresponding to the oxygen-impermeable film employed in the test described above but differing therefrom for a poorly compatible resin that has replaced one of the tie layers. The bond strength between the polyamide layer and said resin in the precursor film was 35 g/25 mm. The obtained oxygen-permeable and oxygen-impermeable portions had a thickness of about 8 and about 17 μm respectively. The inversion was obtained following the process schematically illustrated in FIG. 10 so that the heat-sealing layer of the oxygen permeable film was the layer involved in the delamination. The support members employed were the same as in the above tests. The results obtained in the packaging tests were very good in terms of lack of discoloration of the packaged meat, pack appearance and pack hermeticity.

What is claimed is:

1. A process for the manufacture of a fresh meat package by placing the meat product (14) on a support member (6) and closing the package in a lidding station (4) under a high oxygen-content atmosphere by means of a twin lidding film (3), comprising an inner, food-contact, oxygen-permeable film (15) and an outer oxygen-impermeable film (16), positioned over the meat product and heat-sealed to the periphery of the support member so as to bind a confined volume (19) within the package containing at least an amount of oxygen effective to inhibit discoloration of the packaged meat product, said process comprising the steps of:

a. providing the twin lidding film (3) as a composite from a single supply roll (1), unwinding the film (3) therefrom, and directing the film into the lidding station (4); and b. following unwinding and before entering into the lidding station (4), completely separating the oxygen-permeable film (15) and the outer oxygen-impermeable film (16) of the twin lidding film (3), then superposing the two films again before heat-sealing the films to the support member.

2. The process of claim 1, wherein the separation between the oxygen-permeable film (15) and the oxygen-impermeable film (16) is obtained by interposing between the two films one or more poles (5).

3. The process of claim 1, wherein at least one of the oxygen-permeable film (15) and oxygen-impermeable film (16) are biaxially oriented and heat-shrinkable, and wherein the process further includes a heat-treatment step to produce heat-shrinkage in one or both films.

4. The process of claim 3, wherein both the oxygen-permeable film (15) and the oxygen-impermeable film (16) are biaxially oriented and heat-shrinkable and are selected in such a way as to provide a comparable % shrink at a temperature reached by each film in the heat-treatment step.

5. The packaging process of claim 1, wherein the twin lidding film (3) is a composite of an oxygen-permeable film and an oxygen-impermeable film obtained by a. delaminating an oxygen-impermeable precursor film that comprises a core oxygen-barrier layer and two outer heat-sealable layers into an oxygen-permeable portion, comprising one of the two outer layers of the precursor film, and an oxygen-impermeable portion, comprising the oxygen-barrier layer and the other outer heat-sealable layer of the precursor film; and b. inverting the relative positioning of the oxygen-impermeable portion in such a way that the outer heat-sealable layer in said oxygen-impermeable portion will be the layer directly facing the oxygen-permeable portion in the resultant twin lidding film.

6. The process of claim 1, wherein the twin lidding film is placed over the meat product in such a way that the inner oxygen-permeable film is at least partially in contact with the meat product.

7. A process for the manufacture of a fresh meat package by placing the meat product (14) on a support member (6) and closing the package in a lidding station (4) under a high oxygen-content atmosphere by means of a twin lidding film (3), comprising an inner, food-contact, oxygen-permeable film (15) and an outer oxygen-impermeable film (16), positioned over the meat product and heat-sealed to the periphery of the support member so as to bind a confined volume (19) within the package containing at least an amount of oxygen effective to inhibit discoloration of the packaged meat product, said process comprising the steps of:

a. providing the twin lidding film (3) as a composite from a single supply roll (1), unwinding the film (3) therefrom, and directing the film into the lidding station (4); and b. following unwinding and before entering into the lidding station (4), separating the oxygen-permeable film (15) and the outer oxygen-impermeable film (16) of the twin lidding film (3), then superposing the two films again before heat-sealing the films to the support member such that a volume of gas is entrapped between the oxygen-permeable film (15) and the oxygen-impermeable film (16).

* * * * *